US006668723B2

(12) United States Patent
Berton et al.

(10) Patent No.: US 6,668,723 B2
(45) Date of Patent: Dec. 30, 2003

(54) METHOD FOR REGULATING THE INK-TO-WETTING AGENT EQUILIBRIUM IN A ROTARY OFFSET PRINTING MACHINE

(75) Inventors: Philippe Berton, Bailleval (FR); Alain Blanchard, Gouvieux (FR); Dominique Boillot, Gouvieux (FR); Antoine Chevalier, Gouvieux (FR); Patrick Lepeltier, Angicourt (FR)

(73) Assignee: Heidelberger Druckmaschinen AG, Heidelberg (DE)

( * ) Notice: Subject to any disclaimer, the term of this patent is extended or adjusted under 35 U.S.C. 154(b) by 55 days.

(21) Appl. No.: 09/989,048

(22) Filed: Nov. 20, 2001

(65) Prior Publication Data

US 2002/0073865 A1 Jun. 20, 2002

(30) Foreign Application Priority Data

Nov. 24, 2000 (DE) ..... 100 58 550

(51) Int. Cl.[7] ..... B41M 3/00; B41L 25/00; B01F 17/00

(52) U.S. Cl. ..... 101/483; 101/148; 516/198

(58) Field of Search ..... 101/483, 365, 101/364, 484, 148; 516/198

(56) References Cited

U.S. PATENT DOCUMENTS

| | | | | | |
|---|---|---|---|---|---|
| 4,214,523 | A | * | 7/1980 | Mabrouk et al. | 101/148 |
| 4,388,864 | A | * | 6/1983 | Warner | 101/148 |
| 4,485,737 | A | * | 12/1984 | Jeschke | 101/148 |
| 4,553,478 | A | * | 11/1985 | Greiner et al. | 101/484 |
| 4,699,055 | A | * | 10/1987 | Jeschke | 101/350.1 |
| 4,972,774 | A | | 11/1990 | MacPhee | 101/450.1 |
| 5,031,535 | A | * | 7/1991 | Kipphan et al. | 101/483 |
| 5,090,316 | A | | 2/1992 | Rodi et al. | 101/148 |
| 5,174,210 | A | * | 12/1992 | Rodi et al. | 101/492 |
| 5,224,421 | A | * | 7/1993 | Doherty | 101/211 |
| 5,791,249 | A | * | 8/1998 | Quadracci | 101/450.1 |
| 5,907,999 | A | * | 6/1999 | Lusar et al. | 101/484 |
| 6,119,594 | A | * | 9/2000 | Kipphan et al. | 101/365 |
| 6,194,215 | B1 | * | 2/2001 | Rauh et al. | 436/55 |

FOREIGN PATENT DOCUMENTS

| | | |
|---|---|---|
| DE | 2931579 | 2/1981 |
| DE | 3436582 | 5/1985 |
| DE | 3611631 | 10/1987 |
| DE | 3611645 | 10/1987 |
| DE | 3912811 | 10/1990 |
| DE | 4436582 | 4/1996 |
| JP | 63162243 | 7/1988 |
| JP | 11165398 | 6/1998 |

* cited by examiner

*Primary Examiner*—Andrew H. Hirshfeld
*Assistant Examiner*—Hoai-An D. Nguyen
(74) *Attorney, Agent, or Firm*—Davidson, Davidson & Kappel, LLC

(57) ABSTRACT

A method for regulating the ink-to-wetting agent equilibrium in a rotary offset printing machine, the wetting agent quantity being determined especially using the signals of a sensor which measures the light reflectance of an area on the printing form of the rotary printing machine that is wetted by a wetting agent. The method includes: presetting the wetting agent quantity supplied to the printing form, calibrating the wetting agent quantity supplied at an ink quantity that is essentially kept constant, adjusting the wetting agent quantity to a wetting agent quantity setpoint value that is characteristic for the specific print job, increasing or decreasing the ink quantity from an ink quantity setpoint value to an ink quantity target value that is desirable for the printing job to be processed, and a corresponding increasing or decreasing of the wetting agent quantity setpoint value in the same direction to a wetting agent quantity target value, and regulating the supplied wetting agent quantity in a closed control loop as a function of the wetting agent quantity target value.

23 Claims, 4 Drawing Sheets

METHOD FOR REGULATING THE INK-TO-WETTING AGENT EQUILIBRIUM IN A ROTARY OFFSET PRINTING MACHINE

Priority to German Patent Application No 100 58 550.7, which is hereby incorporated by reference herein, is hereby claimed.

BACKGROUND OF THE INVENTION

The present invention relates to a method for regulating the ink-to-wetting agent equilibrium in a rotary offset printing machine, the quantity of wetting agent being determined specifically using the signals of a sensor which measures the light reflectance of an area that is wetted using wetting agent on a printing form of the rotary printing machine.

If in an offset printing machine, i.e., for example in a sheet-fed rotary offset printing machine or in a web-fed rotary offset printing machine, the printing forms are supplied with too little wetting agent, then the following problem can occur: areas of the printing form that are generally supposed to be ink-free for a specific printing job, in order to generate a print image that is composed of the four primary colors black, yellow, cyan, and magenta, acquire ink. The appearance of ink in the basically ink-free areas of the printing form, caused by a lack of wetting agent, is known in the field of printing technology as smearing, and the quantity of wetting agent supplied, hereinafter termed wetting solution, at which no smearing occurs or at which the smearing begins, is also known as the smearing threshold.

In addition, for an optimal printing result, it is necessary that the so-called ink-to-wetting agent equilibrium be maintained during the offset process, so that an optimal emulsion made of wetting agent and ink, necessary for the printing process, is generated on the printing forms.

From German Patent 44 36 582 C2, it is known to regulate the wetting agent quantity for a printing form of an offset rotary printing machine that is in operation, a number of measuring values being repeatedly measured when there is a change in the quantity of wetting agent at a given rotational angle of the printing form. The dispersion value of the measuring values is calculated from them, differential amounts of the dispersion values being arrived at, and the smearing threshold being established when one of the differential amounts exceeds a preestablished differential value. Thereupon the wetting agent quantity for the continued printing is increased by a preestablished amount and is maintained such that the measuring values on average remain constant. The German '582 Patent provides no information as to combining wetting solution regulation with a change in the ink control, specifically an ink regulation, as a result of which the quantity of ink in the printing areas of a printing form occupied by ink are controlled or regulated during the continued printing operation.

Furthermore, from German Patent Application No. 29 31 579, a device is known for the zonal regulation of the wetting agent supply, in which the actuators for the zonal ink metering—hereinafter also known as ink zone screws—are coupled to the actuators for the wetting agent control, which are assigned to the ink zone screws and which correspond to zones. In this context, the coupling takes place in a mechanical manner using a mechanical control gear. The publication provides no information as to calibrating the wetting agent quantity when the ink quantity is essentially maintained at a constant level.

SUMMARY OF THE INVENTION

Accordingly, it is one objective of the present invention to create a method for regulating the ink-to-wetting agent equilibrium in a rotary offset printing machine, which makes it possible to adjust the optimum emulsion of ink and wetting agent in the shortest possible time and with a high degree of reproducibility.

The present invention provides a method for regulating the ink-to-wetting agent equilibrium in a rotary offset printing machine, the wetting agent quantity being determined especially using the signals of a sensor which measures the light reflectance of an area on the printing form of the rotary printing machine that is wetted by a wetting agent. The method includes:

- presetting the wetting agent quantity supplied to the printing form,
- calibrating the wetting agent quantity supplied at an ink quantity that is essentially kept constant,
- adjusting the wetting agent quantity to a wetting agent quantity setpoint value that is characteristic for the specific print job,
- increasing or decreasing the ink quantity from an ink quantity setpoint value to an ink quantity target value that is desirable for the printing job to be processed, and a corresponding increasing or decreasing of the wetting agent quantity setpoint value in the same direction to a wetting agent quantity target value, and
- regulating the wetting agent quantity supplied in a closed control loop as a function of the wetting agent quantity target value.

According to the method in accordance with the present invention for regulating the ink-to-wetting agent equilibrium in a rotary offset any machine, the method preferably being realized by appropriate control and regulation software in a known printing machine controlling and regulating device, the wetting agent quantity supplied to a pressure plate or printing form is determined by the signals of a sensor. The sensor advantageously determines the light reflectance of an area on the printing form that is wetted by a wetting agent and that is preferably not to be printed. For this purpose, the sensor can detect, for example, the reflected light of a laser, which is oriented in the normal direction or at an angle to the area of the printing form not to be printed. As a function of the detected light intensity, the sensor then can generate a sensor signal which represents a measure for the light reflectance of the pressure plate, which in turn is a function of the quantity of wetting agent in the area. According to the present invention, the quantity of wetting agent to be supplied to the printing form for the specific printing job is preset, which can take place, for example, in the familiar manner by interconnection or by varying the application pressure between the rollers controlling the wetting agent in the wetting apparatus of the printing machine, or in another familiar manner. Presetting the wetting agent quantity supplied to the printing form and/or presetting the ink quantity supplied to the printing form is preferably accomplished, in this context, when the printing machine is at a standstill, or is in crawling mode, as a result of which the amount of spoilage is reduced in an advantageous manner.

Presetting the wetting agent quantity, in this context, is preferably accomplished on the basis of a presetting signal value, which corresponds to the signal value of the sensor for the wetting agent target value, which was determined by the sensor during a preceding printing job. The wetting agent quantity target value of the preceding printing job, or the signal value of the sensor assigned thereto, essentially corresponding to the wetting agent quantity that is optimal for the preceding job, can be stored, for example, in a storage unit. In this way, the advantage is achieved that presetting the wetting agent quantity can be accomplished in a simple manner by increasing the wetting agent quantity until the signal value measured by the sensor corresponds to the stored signal value.

In the same way, it is possible to carry out the presetting of the wetting agent quantity on the basis of a calculated presetting signal value, which is advantageously determined by averaging the signal values of the sensor for the wetting agent quantity target values during two or more preceding printing jobs. In this context, it is assumed that the wetting agent quantity target values of the preceding printing jobs essentially correspond to the optimal wetting agent quantity at the ink quantity set in the given case, the wetting agent quantity having resulted in an optimal ink-wetting agent emulsion in the preceding printing jobs. As a result of the averaging, the influence is reduced of the signal values of the sensor which have been measured at a non-optimal setting of the ink-to-wetting agent equilibrium during the preceding printing jobs and which have been stored for calculating the average value.

To assure that the printing machine is operated on the basis of an excess of wetting agent when it is started up, it can be provided that the presetting signal value is multiplied by a factor that is preferably selectable by the machine operator, or a value that is preferably selectable can be added to it. As a result of the excessive application of wetting solution when the printing machines are started up, the quantity of spoilage is advantageously reduced until an acceptable printing quality has been achieved, and the danger is reduced of paper fibers or other contaminants of the printed material penetrating or escaping into the printing mechanism or even into the dampening mechanism because of the adhesive qualities of the printing ink.

Subsequent to presetting the wetting agent quantity supplied, the wetting agent quantity is reduced, for example, by reducing the rotational speed of the drawing roller or by reducing the interconnection angle between the drawing roller and the wetting agent metering roller assigned to it, or in another familiar manner when the printing machine is running, until the signal of the sensor traverses a minimum in the range of the smearing threshold and once again rises. The quantity of wetting agent is thus calibrated. The signal of the sensor at the minimum level, which can be more precisely determined by further known mathematical methods, is preferably stored in a storage unit of an associated control device.

Subsequently, the wetting agent quantity, on the basis of the stored value, is once again increased until the signal of the sensor indicates a value which corresponds to a wetting agent quantity setpoint value. The wetting agent quantity setpoint value can be determined, for example, by multiplying the signal value of the sensor at the minimum level by a preestablished factor, and it can, for example, be in the area of 14% above the signal value of the sensor at the minimum level.

Similarly, it is conceivable that to the signal value of the sensor at the minimum level a value is added which advantageously can be modified and can be stipulated by the operator of the printing machine, and which is determined advantageously empirically, or it is determined by taking into account the ink-surface coverage of the printing form. The preestablished factor or the value added to the wetting agent quantity setpoint value is advantageously also selectable by the machine operator. In this manner, the advantage is achieved that the optimal wetting agent quantity setpoint value can easily be changed by the printer if the ink-to-wetting agent equilibrium diverges from a customary setpoint value, for example, as a result of the choice of a different wetting agent additive or as a result of the choice of a different printing ink.

The preestablished factor or the value added to the wetting agent quantity setpoint value is advantageously determined on the basis of the signal values of the sensor, which were determined in response to the wetting agent target values for the preceding printing job(s), and which are advantageously stored in a storage unit of the printing machine.

After the wetting agent quantity is advantageously increased by adjusting an associated actuator, for example, by increasing the rotational speed of the wetting agent drawing roller or by increasing the setting angle that a drawing roller and a metering roller connected to the latter, until the signal of the sensor corresponds to the signal for the wetting agent quantity setpoint value, the wetting agent quantity in a preferably closed control circuit is set at this wetting agent quantity setpoint value. For this purpose, it is possible to use, for example, an appropriately configured control circuit, for example, a PID controller, which is preferably also realized through software in the (central) printing machine control and regulation device.

If the ink quantity which is supplied to the pressure plate in one or more ink zones, subsequent to reaching the wetting agent setpoint value, is increased or reduced from an ink quantity setpoint value to a desired ink quantity target value—which can be done manually, for example, by the printer after an inspection of the first printed copies or automatically by the machine control unit if there is an automatic ink quantity control or regulation system, then, in accordance with the present invention, the wetting agent setpoint value is increased to a wetting agent target value in a corresponding manner and in the same direction.

In this context, according to a further specific embodiment of the present invention, increasing or decreasing the wetting agent quantity target value takes place essentially simultaneously with increasing or decreasing the ink quantity to the new ink quantity target value, as a result of which there is a markedly rapid regulation, which makes it possible to further reduce the amount of spoilage occurring. However, in the same way, it can also be provided that the wetting agent quantity target value is only increased or decreased for a preferably specifiable time duration after the time point at which the ink quantity target value was set by the ink zone control or regulation system. In this way of adjusting the wetting agent quantity target value, there is the advantage that in regulating the ink quantity in the individual ink zones, the combined ink quantity regulation and wetting agent quantity regulation is less susceptible to overloads and fluctuations.

According to one preferred embodiment of the present invention, the value by which the wetting agent quantity target value is increased or decreased is determined using stored or calculated signal values of the sensor, which are assigned to a specific increase or decrease of the ink quantity target value. The stored signal values of the sensor are preferably determined empirically and, together with the associated values for an increase or decrease of the ink quantity target value, are stored in a storage unit of the printing machine, for example, in a characteristics field, as parameters or parametrized curves.

According to the preferred embodiment of the present invention, the ink quantity target value is changed in a closed control loop (i.e., a feedback circuit), for which purpose the ink coverage or ink density on the printing form or on the printing stock is determined in accordance with a method known from the related art, for example, densitometrically or colorimetrically, using a corresponding sensor.

According to a further embodiment, the wetting agent quantity supplied is regulated within a narrow range around the wetting agent quantity target value in a closed control loop as a function of the wetting agent target value, so that fluctuations are reduced of the wetting agent quantity value, measured by the sensor, around the wetting agent quantity target value. In this context, it is possible that the regulating device advantageously takes into account in the regulating process other parameters, such as the temperature of the wetting agent or of the pressure plate, and/or the speed of the printing machine, so as to obtain a reliable regulation of the wetting agent quantity.

BRIEF DESCRIPTION OF THE DRAWINGS

The present invention is described below with reference to the drawings on the basis of an exemplary embodiment, in which.

DETAILED DESCRIPTION

Figure 1:
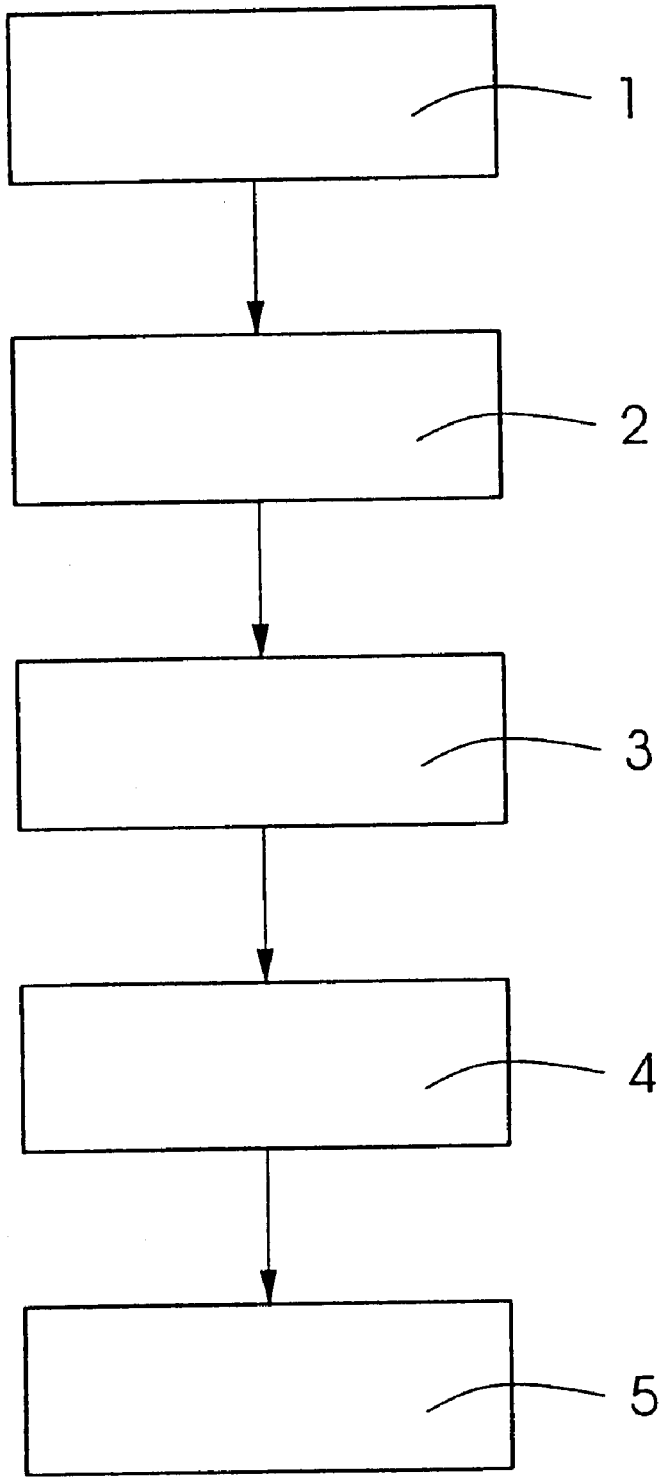
FIG. 1 depicts a flowchart of the method steps to be carried out in accordance with the method according to the present invention.
Figure 2:
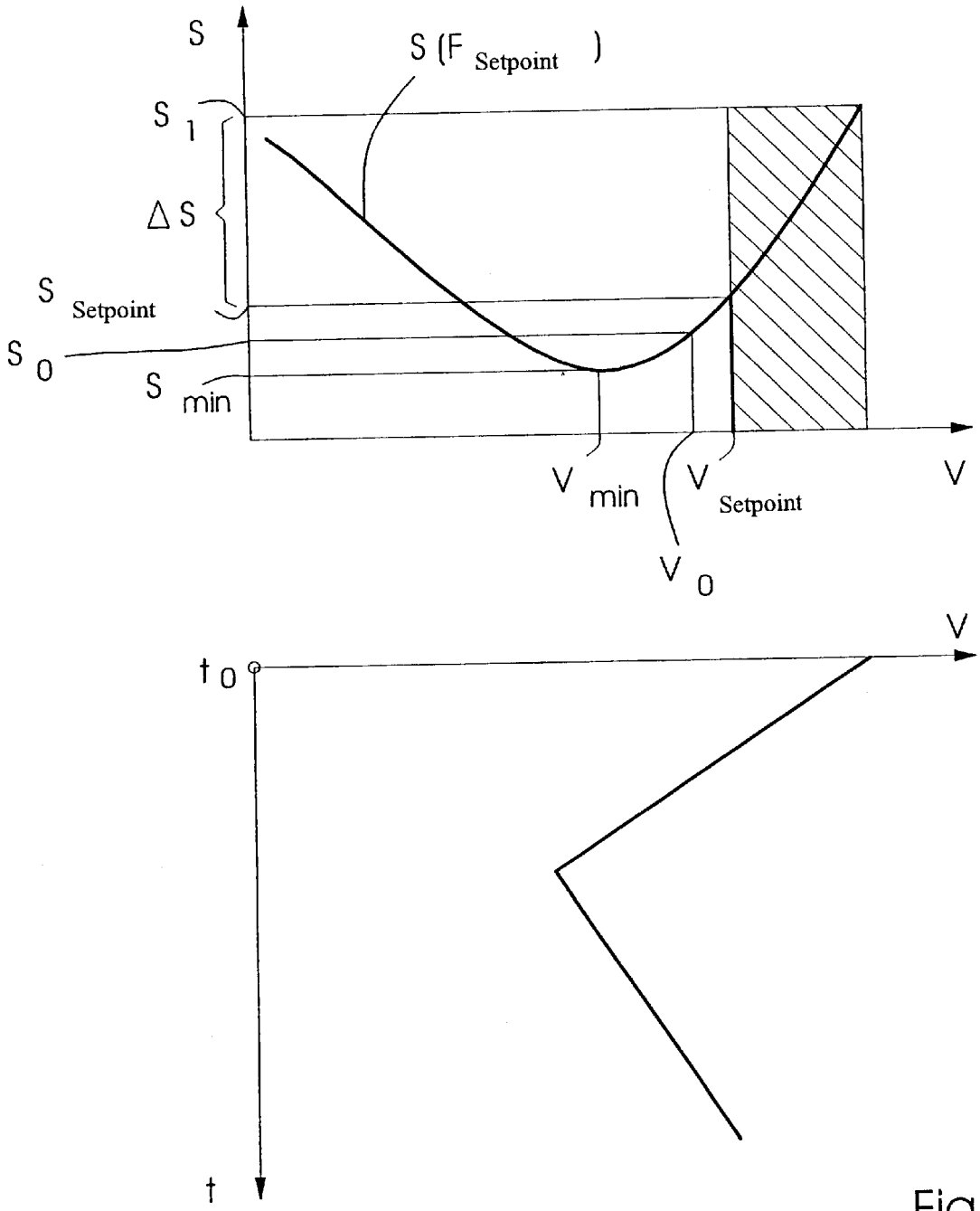
FIG. 2 depicts the temporal curve of the wetting agent quantity supplied and the associated curve of the sensor signal during presetting and the calibrating process and in response to increasing the supplied wetting agent quantity to the wetting agent quantity setpoint value.

As is depicted in FIG. 1, in a first method step 1, the wetting agent quantity supplied to the printing form is set at a wetting agent preset value $V_0$ when the printing machine is at a standstill. In this context, as is shown in FIG. 2, a presetting is carried out on the basis of a presetting signal value $S_0$ that is measured by an undepicted sensor, the wetting agent quantity supplied being preferably increased to the presetting signal value when the printing machine is at a standstill or in crawling operation. To assure an overdampening during the calibration of the wetting agent quantity in subsequent method step 2, the wetting agent quantity supplied is subsequently increased during the crawling operation of the printing machine until the presetting signal value of the sensor has been increased by a value $\Delta S$ to a higher presetting signal value $S_1$.

In subsequent method set 2, as is depicted in FIGS. 1 and 2, a calibration is subsequently carried out of the wetting agent quantity supplied at an ink quantity that is essentially kept constant. For this purpose, the wetting agent quantity at time point $t_0$ (compare the lower half of FIG. 2) is reduced from the value corresponding to presetting signal value $S_1$ for the wetting agent quantity until signal S of the sensor traverses a minimum at point $V_{min}$. Corresponding value $S_{min}$ of sensor signal S is stored at the minimum value and is used as a fundamental value or reference value for the further controlling and regulating processes of the wetting agent quantity and/or of the ink quantity.

In the method step designated in FIG. 1 as reference numeral 3, the wetting agent quantity is subsequently adjusted to a wetting agent quantity setpoint value $V_{Setpoint}$ that is characteristic for the specific printing job, which can take place by once again continuously increasing wetting agent quantity V after minimum $V_{min}$ has been traversed, until signal value S of the sensor reaches setpoint signal value $S_{Setpoint}$.

Figure 3:
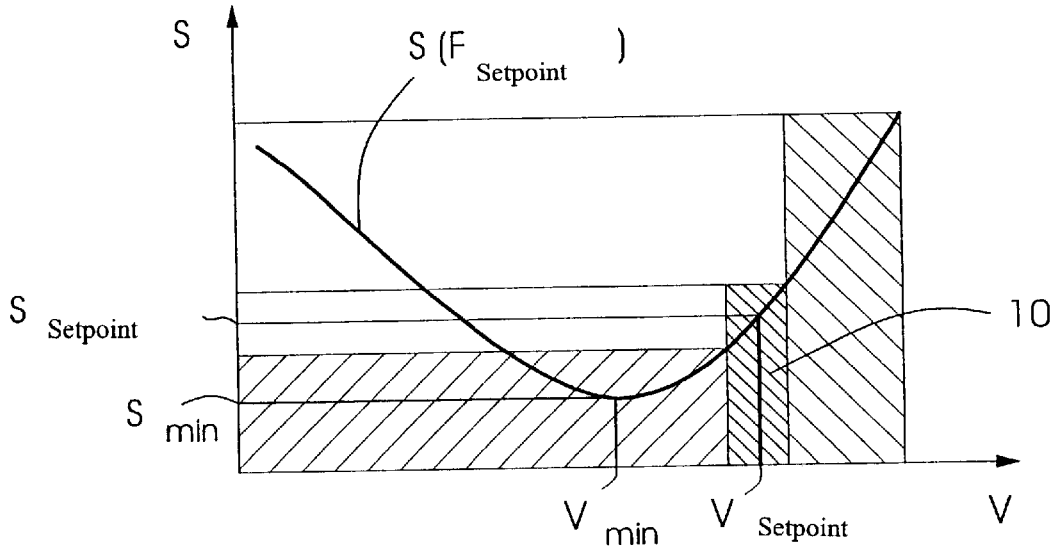
FIG. 3 depicts the signal curve as a function of the wetting agent quantity supplied having the indicated control range for the wetting agent quantity around the wetting agent quantity setpoint value and having the associated sensor signals.

As is depicted in FIG. 3, subsequently the wetting agent quantity is regulated around wetting agent quantity setpoint value $V_{Setpoint}$ using signals S of the sensor—the regulating advantageously occurring in a closed control loop—such that wetting agent quantity V is located in range 10, indicated in FIG. 3 by cross hatching, in which an ink-to-wetting agent emulsion is obtained that is optimal for the printing process. In this context, the ink quantity is set at an essentially constant ink quantity setpoint value $F_{Setpoint}$, which is determined, for example, as a function of the ink coverage on the printing form for the appropriate color on the basis of preliminary printing data. Ink quantity setpoint value $F_{Setpoint}$ is expressed in FIG. 3 through sensor signal S being a function of ink setpoint value $F_{setpoint}$.

Figure 4:
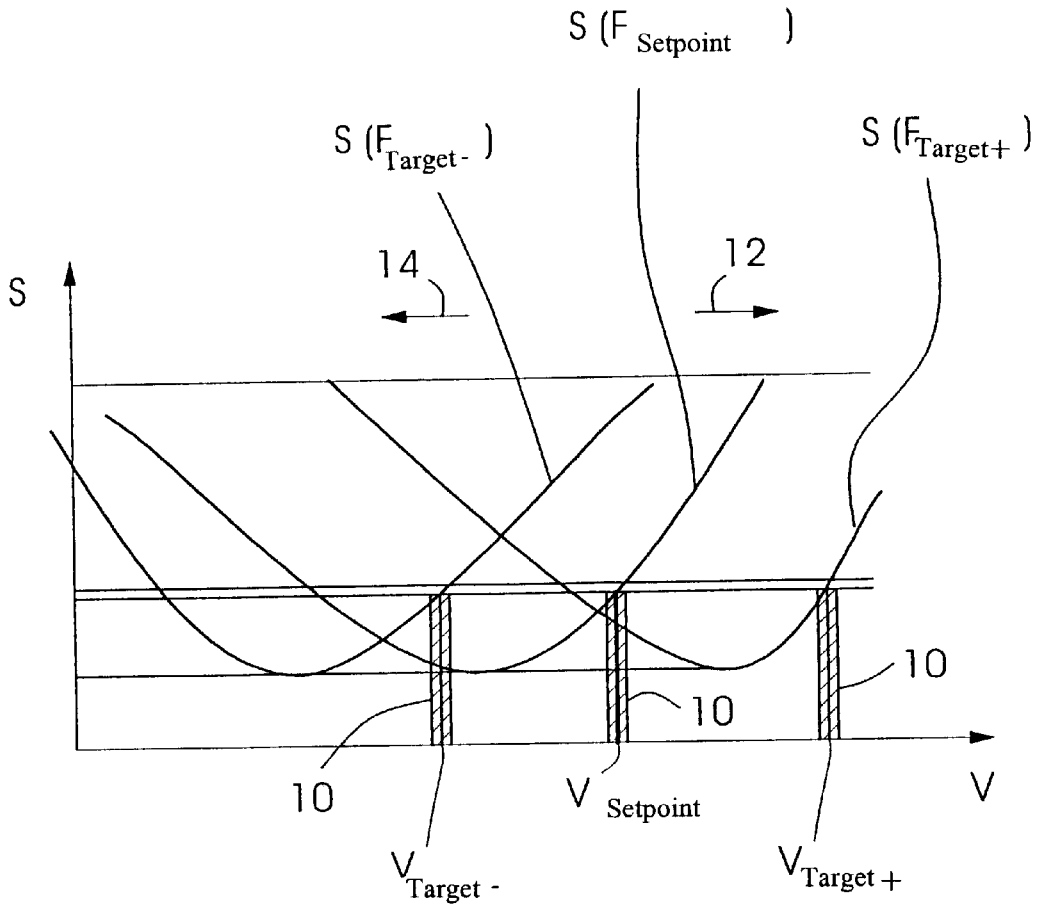
FIG. 4 depicts the curve of the sensor signal as a function of the wetting agent quantity supplied after an increase or a decrease of the supplied wetting agent quantity to an increased or decreased wetting agent quantity target value after a corresponding increase or decrease of the ink quantity from the ink quantity setpoint value to a new ink quantity target value.

In a following method step 4 (FIG. 1), the ink quantity is increased from ink quantity setpoint value $F_{Setpoint}$ to an ink quantity target value $F_{Target}$ that is desirable for the printing job to be processed, or it is decreased to a lower ink quantity target value $F_{Target}$, which is expressed in FIG. 4 by signal curves $S(F_{Target+})$ and $S(F_{Target-})$ which lie to the right and to the left of signal curve $S(F_{Setpoint})$.

As can further be inferred from FIG. 4, when the ink quantity is increased from ink quantity setpoint value $F_{Setpoint}$ to a higher ink quantity target value $F_{Target+}$, the wetting agent quantity is also increased to a higher wetting agent quantity target value $V_{Target+}$, which is expressed by the curve that is displaced in the direction of arrow 12 for signal curve S of the sensor.

In a similar way, wetting agent quantity supplied V is reduced from wetting agent quantity setpoint value $V_{Setpoint}$ to a lower wetting agent target value $V_{Target-}$, if the ink quantity in accordance with arrow 14 is reduced from ink quantity setpoint value $F_{Setpoint}$ to lower ink quantity target value $F_{Target-}$. In the preferred embodiment of the present invention, the different curves of the set of curves for signal curve S, in response to increasing or decreasing the ink quantity, of which in FIG. 4 only three curves are depicted by way of example, are advantageously stored in a characteristics field as parameters, so that the wetting agent quantities associated to the signal values can be assigned by selecting the parameters. However, in the same way, it is also conceivable that the values of sensor signal S that are dependent on ink quantity F and wetting agent quantity V are stored as parametrized curves in a storage unit of the controlling and regulating device, which can calculate appropriate signal values S or wetting agent quantities depending on precisely which quantity is known and which is required.

Subsequently, in a fifth method step, wetting agent quantity supplied V is regulated in a closed control loop as a function of wetting agent quantity target value $V_{Target-}$, $V_{Target+}$, which advantageously takes place as a function of the signal values for specific wetting agent quantity target values $V_{Target-}$ and $V_{Target+}$ within range 10 that is optimal for the specific ink-to-wetting agent emulsion (compare FIG. 3), the latter being indicated only schematically in FIG. 4.

List of reference numerals

V wetting agent quantity supplied $V_0$ wetting agent quantity at presetting signal value $V_{Setpoint}$ wetting agent quantity setpoint value $V_{min}$ wetting agent quantities at the smearing threshold $V_{Target}$ wetting agent quantity target value ΔS value by which the presetting signal value is increased $S_0$ sensor signal $S_1$ presetting signal value SI presetting signal value $S_{min}$ value of the sensor signal at the minimum level $S_{Setpoint}$ value of the sensor signal at the wetting agent quantity setpoint value t time $t_0$ starting time point at which the calibration begins $F_{Setpoint}$ ink quantity setpoint value $F_{Target+}$ increased ink quantity setpoint value $F_{Target-}$ decreased ink quantity setpoint value

1 first method step

2 second method step

3 third method step

4 fourth method step

5 fifth method step

10 range of the optimal ink-to-wetting agent emulsion

12 arrow

14 arrow

What is claimed is:

1. A method for regulating the ink-to-wetting agent equilibrium in a rotary offset printing machine, comprising the steps of:

presetting a wetting agent quantity supplied to a printing form;

calibrating the wetting agent quantity supplied at a certain ink quantity;

adjusting the wetting agent quantity to a wetting agent quantity setpoint value that is characteristic for a specific print job;

increasing or decreasing the ink quantity from an ink quantity setpoint value to an ink quantity target value desirable for the specific printing job;

increasing or decreasing the wetting agent quantity setpoint value in a same direction as the increasing or decreasing of the ink quantity to a wetting agent quantity target value; and regulating the wetting agent quantity supplied in a closed control loop as a function of the wetting agent quantity target value;

wherein the wetting agent quantity supplied for the calibrating step is reduced until a signal of a light reflectance sensor traverses a minimum level.

2. The method as recited claim 1, wherein the increasing or decreasing of the wetting agent quantity setpoint value occurs simultaneously with the increasing or decreasing of the ink quantity to the desired ink quantity target value.

3. The method as recited in claim 1, wherein a deviation value by which the wetting agent quantity setpoint value is increased or decreased is determined using stored or calculated signal values of the light reflectance sensor, the signal values being assigned to each specific increase or decrease of the ink quantity target value.

4. The method as recited claim 3, wherein the stored signal values of the sensor are determined empirically and are stored, together with the appropriate values for increasing or decreasing the ink quantity target value, in a storage device of the printing machine.

5. The method as recited claim 1, wherein at least one of the presetting of the wetting agent quantity supplied to the printing form and a presetting of the ink quantity takes place when the printing machine is at a standstill.

6. The method as recited in claim 1, wherein the presetting of the wetting agent quantity takes place as a function of a presetting signal value, the presetting signal value corresponding to a signal value of the light reflectance sensor for a previous wetting agent quantity target value during a preceding printing job.

7. The method as recited claim 1, wherein the presetting of the wetting agent quantity takes place on the basis of a calculated presetting signal value, the presetting signal value being determined through averaging signal values of the light reflectance sensor for previous wetting agent quantity target values during two or more preceding printing jobs.

8. The method as recited claim 1, wherein the presetting signal value is multiplied to assure an overdampening during the start-up of the printing machine, the presetting signal value being multiplied by a factor that is selectable by the machine operator, or is increased by a selectable value.

9. The method as recited in claim 8, wherein the signal value is determined for the wetting agent quantity target value during crawling operation or during the continued printing operation of the printing machine.

10. The method as recited in claim 7, wherein the signal value is determined for the wetting agent quantity target value during crawling operation or during the continued printing operation of the printing machine.

11. The method as recited in claim 6, wherein the signal value is determined for the wetting agent quantity target value during crawling operation or during the continued printing operation of the printing machine.

12. The method as recited in claim 1, wherein the wetting agent quantity setpoint value is determined by adding a predetermined value to the signal value of the sensor at the minimum level and, after the minimum is traversed, the wetting agent quantity supplied is once again increased until the signal of the sensor has a value which corresponds to the wetting agent quantity setpoint value.

13. The method as recited in claim 1, wherein, for adjusting the wetting agent quantity, the wetting agent quantity setpoint value is determined by multiplying a signal value of the sensor at the minimum level by a preselected factor, and after the minimum level is traversed, the wetting agent quantity supplied is increased until the signal of the sensor has a value which corresponds to the wetting agent quantity setpoint value.

14. The method as recited in claim 12, wherein the predetermined value added to the wetting agent quantity setpoint value is determined as a function of the signal values of the sensor that correspond to the wetting agent target values for preceding printing jobs, the target values being stored in a storage unit of the printing machine.

15. The method as recited in claim 12, wherein the predetermined value added to the wetting agent quantity setpoint value is preselectable by the machine operator, and, after the minimum has been traversed, the wetting agent quantity supplied is once again increased until the signal of the sensor has a value which corresponds to the wetting agent quantity setpoint value.

16. The method as recited in claim 13, wherein the preselected factor is determined as a function of the signal values of the sensor that correspond to the wetting agent target values for preceding printing jobs, the target values being stored in a storage unit of the printing machine.

17. The method as recited in claim 13, wherein the preselected factor is preselectable by the machine operator, and, after the minimum has been traversed, the wetting agent quantity supplied is once again increased until the signal of the sensor has a value which corresponds to the wetting agent quantity setpoint value.

18. The method as recited in claim 1, wherein increasing or decreasing the ink quantity to the ink quantity target value takes place in a closed control circuit using the light reflectance sensor and at least one ink sensor.

19. The method as recited in claim 18, wherein the ink sensor determines an ink density on the printing form or on the printing stock colorimetrically or densitometrically.

20. The method as recited in claim 1, wherein an ink quantity supplied to the printing form before the calibrating step is set at the ink quantity setpoint value.

21. The method as recited in claim 1, wherein the calibrating step takes place before a start-up of the printing machine to operating speed.

22. The method as recited in claim 1, wherein the regulating step of the wetting agent quantity supplied takes place in a closed control circuit as a function of the wetting agent quantity target value, such that fluctuation of the measured wetting agent quantity value around the wetting agent quantity target value is reduced.

23. The method as recited in claim 1, further comprising determining the wetting agent quantity as a function of signals of the light reflectance sensor, the light reflectance sensor measuring light reflectance of an area on the printing form of the rotary printing machine that is wetted by a wetting agent.

* * * * *